US009010032B2

(12) United States Patent
Scaramucci

(10) Patent No.: US 9,010,032 B2
(45) Date of Patent: Apr. 21, 2015

(54) DEVICE FOR THE CONNECTION OF EQUIPMENT TO FLOORING

(75) Inventor: Silvia Scaramucci, Milan (IT)

(73) Assignee: Queenax S.R.L., Ancarano (TE) (IT)

( * ) Notice: Subject to any disclaimer, the term of this patent is extended or adjusted under 35 U.S.C. 154(b) by 0 days.

(21) Appl. No.: 14/110,987

(22) PCT Filed: Apr. 13, 2012

(86) PCT No.: PCT/IB2012/051822

§ 371 (c)(1),
(2), (4) Date: Nov. 15, 2013

(87) PCT Pub. No.: WO2012/140605

PCT Pub. Date: Oct. 18, 2012

(65) Prior Publication Data

US 2014/0059944 A1 Mar. 6, 2014

(30) Foreign Application Priority Data

Apr. 13, 2011 (IT) ..... MI2011A0625

(51) Int. Cl.

| | |
|---|---|
| ***E04B 5/43*** | (2006.01) |
| ***A63B 21/16*** | (2006.01) |
| ***A63B 71/02*** | (2006.01) |

(52) U.S. Cl.

CPC . *E04B 5/43* (2013.01); *A63B 21/16* (2013.01); *A63B 71/023* (2013.01); *A63B 71/028* (2013.01); *A63B 2209/08* (2013.01); *A63B 2210/00* (2013.01); *A63B 2225/72* (2013.01)

(58) Field of Classification Search

USPC ..... 52/36.4, 36.5, 403.1, 514, 514.5; 248/678, 508; 482/23; 285/56; 335/285, 286; 40/711

See application file for complete search history.

(56) References Cited

U.S. PATENT DOCUMENTS

| | | | | |
|---|---|---|---|---|
| 3,239,178 | A * | 3/1966 | Pompa | 248/205.3 |
| 3,298,653 | A | 1/1967 | Omholt | |
| 5,472,163 | A * | 12/1995 | Callas | 248/206.5 |
| 5,577,696 | A * | 11/1996 | Kramer | 248/206.5 |
| 5,623,801 | A * | 4/1997 | Drumbl | 52/514 |
| 6,859,146 | B2 * | 2/2005 | McGreal et al. | 340/693.6 |
| 6,994,305 | B2 * | 2/2006 | Schenk, Jr. | 248/205.1 |
| 2006/0174529 | A1 * | 8/2006 | Sachs-Lavery | 40/711 |
| 2007/0022691 | A1 * | 2/2007 | Geller | 52/514 |
| 2008/0078903 | A1 * | 4/2008 | Struthers et al. | 248/231.91 |
| 2009/0251250 | A1 * | 10/2009 | Tait et al. | 335/285 |
| 2011/0011994 | A1 * | 1/2011 | Ahlstrom | 248/205.4 |
| 2011/0265409 | A1 * | 11/2011 | Pien | 52/309.1 |

FOREIGN PATENT DOCUMENTS

| | | |
|---|---|---|
| DE | 84 04 216 | 9/1984 |
| DE | 92 10 011 | 9/1992 |
| DE | 198 44 268 | 3/2000 |

OTHER PUBLICATIONS

International Search Report dated Apr. 5, 2013, corresponding to PCT/IB2012/051822.

* cited by examiner

*Primary Examiner* — Beth Stephan
(74) *Attorney, Agent, or Firm* — Young & Thompson

(57) ABSTRACT

A device (1) for the connection of gymnastic equipment to the flooring (30) of a gymnasium or the like, includes a support (2) which can be placed in a housing (50) produced in a flooring (30) and accessible from an opening (A), at least one electromagnet (8) mounted on the support (2) which can be connected to a control device (100), at least one slab (11, 12) adapted to be placed in the opening (A) resting on the support (2), the slab (11, 12) including at least one portion (11*a*, 12*a*) made of ferromagnetic material, the upper surface (14) of the slab being substantially flat or being provided with elements (13) for the connection of gymnastic equipment.

42 Claims, 7 Drawing Sheets

DEVICE FOR THE CONNECTION OF EQUIPMENT TO FLOORING

FIELD OF THE INVENTION

The present invention relates to a device for the connection of gymnastic equipment to the flooring of a gymnasium of the like and a flooring provided with said device.

More in detail, the invention relates to a device for the connection of a plurality of different types of gymnastic equipment to the flooring of a gymnasium, which allows the usable floor surface of said flooring to remain unchanged when said device is not used.

The invention is conceived to tackle problems relating to the lack of space in gymnasiums, clubs and the like, and at the same time allow a wide range of gymnastic and motor exercises to be performed.

An increasingly widespread problem in the fitness sector, and specifically in gymnasiums, clubs, sports centres (but also in motor rehabilitation centres) is that of providing clients with an increasing wide range of gymnastic and motor activities to choose from and practice the one or ones preferred.

Generally, these centres comprise an area equipped with fixed machinery where predetermined exercises are performed, and an area comprising one or more rooms in which free body exercises and other gymnastic activities can be performed.

However, many of these activities, even the most simple, require a minimum of equipment and adequate space configured for the use of said equipment.

However, the high number of gymnastic activities (courses) proposed in each gymnasium or centre naturally do not consent a room or space to be dedicated to each activity.

In particular, it is important for the floor of the room to remain completely clear, i.e. not to have fixed or non-removable installations, to allow activities in which people move more or less freely within the room, such as step aerobics, aerobics or the like, to be practiced.

For these reasons, fixed equipment or devices for the connection of removable equipment, where required, can currently only be placed on the walls or on the ceiling of the room.

Therefore, the flooring is utilized, besides as usable floor surface, only for positioning some equipment (such as aerobic step platforms, mats, balls etc.) which must be put in place before the start of the activity or of the course, and removed at the end of it.

However, this equipment can only be placed on the flooring, without it being possible to fasten it, greatly limiting the range of equipment that can be utilized and the number of exercises that can be practiced in these rooms.

However, there are some activities, such as functional training, TRX and the like, which are currently becoming increasingly popular, with exercises that require the use of elastic bands, ropes or the like, which must be secured at one end thereof to a supporting structure capable of opposing the force applied by the user.

Likewise, other gymnastic equipment such as steps, poles, crossbars or the like, used for a variety of exercises, also require to be solidly fastened to support the weight or the force exerted by the person.

In the majority of cases said supporting structures of known type are arranged along the walls of the rooms and secured thereto by means of masonry works, dowels or the like.

However, these prior art solutions have some problems.

In fact, by only utilizing the space in proximity of the perimeter of the room, this considerably limits the amount of equipment that can be installed and consequently the number of users that can practice the activity simultaneously.

Moreover, in the majority of cases these are fixed structures or equipment (installed using masonry works) which cannot be replaced with others suitable for practicing different activities, except by restructuring or reconfiguring the rooms.

There are also known support structures arranged and secured in proximity of the ceiling of the room for the connection of equipment such as elastic ropes, cloths and the like.

However, although said structures enable the whole of the surface of the room to be utilized, they have limitations in relation to the type of equipment that can be connected (many types of equipment cannot be connected to the ceiling) or in any case to the use and in the movements with some types of equipment such as elastic bands, ropes and the like (for example the force on the elastic band or on the rope hung from the ceiling can be exerted substantially only downwards).

SUMMARY OF THE INVENTION

In this context, the object of the present innovation is to propose a device for the connection of gymnastic equipment to the flooring of a gymnasium or the like, which overcomes the drawbacks of prior art.

In detail, the object of the innovation is to propose a device for the connection of gymnastic equipment to the flooring of a gymnasium or the like, which enables rapid and simply connection, and vice versa removal, of a plurality of pieces of equipment for the performance of a variety of gymnastic activities.

More in detail, the object of the present innovation is to propose a device for the connection of gymnastic equipment which enables the usable floor surface of the flooring to remain unchanged when the device is not used.

Another object of the present innovation is to propose a flooring for a gymnasium or the like, provided with said device, which can be simply and rapidly reconfigured for the use of different equipment, enabling clients to perform a wide range of gymnastic and motor activities.

The aforesaid objects are achieved substantially by a device for the connection of gymnastic equipment to the flooring of a gymnasium or the like, comprising a support which can be placed in a housing produced in a flooring and accessible from an opening, at least one electromagnet mounted on said support which can be connected to a control device, at least one slab adapted to be placed in the opening resting on said support, said slab comprising at least one portion made of ferromagnetic material, the upper surface of said slab being substantially flat or being provided with means for the connection of gymnastic equipment.

Therefore, by acting on the control device that activates or deactivates the electromagnet it is possible for the slab to be made integral with the device or released therefrom; in this way, it is possible to rapidly and simply replace a slab provided with means for the connection of gymnastic equipment with a flat slab, to obtain a usable floor surface of the flooring.

In detail, the support comprises a body with a bearing surface of said slab; the electromagnet is provided with a magnetisable surface placed substantially at the same level as said bearing surface of the support.

Thanks to said bearing surface, it is possible to use or load the slab as any other point of the flooring without the risk of subsidence.

In particular, the support is placed in the housing in such a manner that the bearing surface remains at a lower height with respect to the surface of the flooring. The slab, having a thickness equal to the difference in height between said bearing surface of the support and said surface of the flooring, remains perfectly level with the rest of the flooring without having raised parts or projecting edges which could be dangerous for clients practicing the exercises.

To facilitate removal and replacement of the slab the device is provided with pusher means adapted to push said slab upward in such a manner as to make it project partially from the opening of the flooring.

The aforesaid objects are also achieved by a flooring for gymnasiums provided with one or more devices such as those described above.

Said flooring also comprises a control device adapted to supply power to the electromagnets and an interface connected thereto to activate or deactivate said electromagnets.

BRIEF DESCRIPTION OF THE DRAWING

Further characteristics and advantages will be more apparent from the indicative, and therefore non-limiting, description of an example of a preferred but not exclusive embodiment of the invention, as shown in the accompanying figures wherein.

DETAILED DESCRIPTION OF THE INVENTION

With reference to the accompanying figures, the device for the connection of gymnastic equipment, indicated as a whole with 1, comprises a support 2 adapted to be placed in a housing 50 produced in a flooring of a gymnasium or the like, and accessible from an opening A at the level of the surface of said flooring.

Figure 3A:
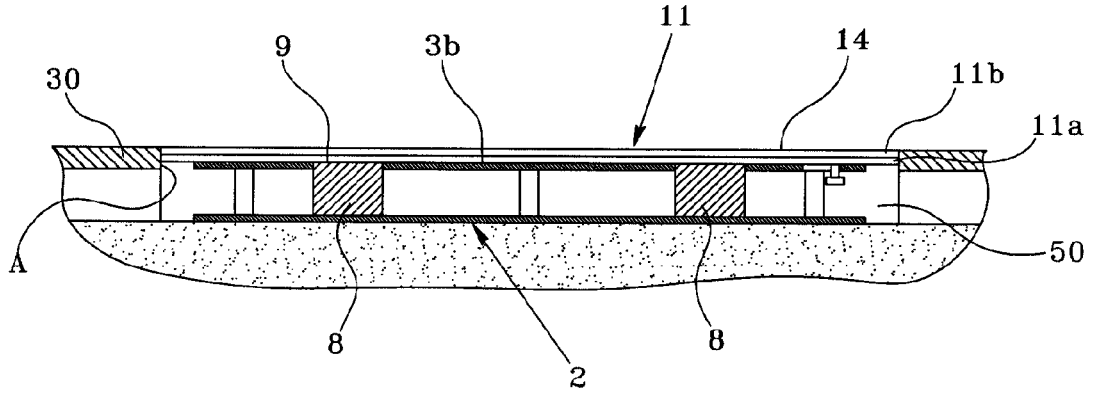
FIGS. 3*a* and 3*b* are two sectional views of the device of FIG. 1, in a housing produced in a flooring, respectively provided with the slab with flat upper surface and provided with the means for the connection of gymnastic equipment.
Figure 3B:
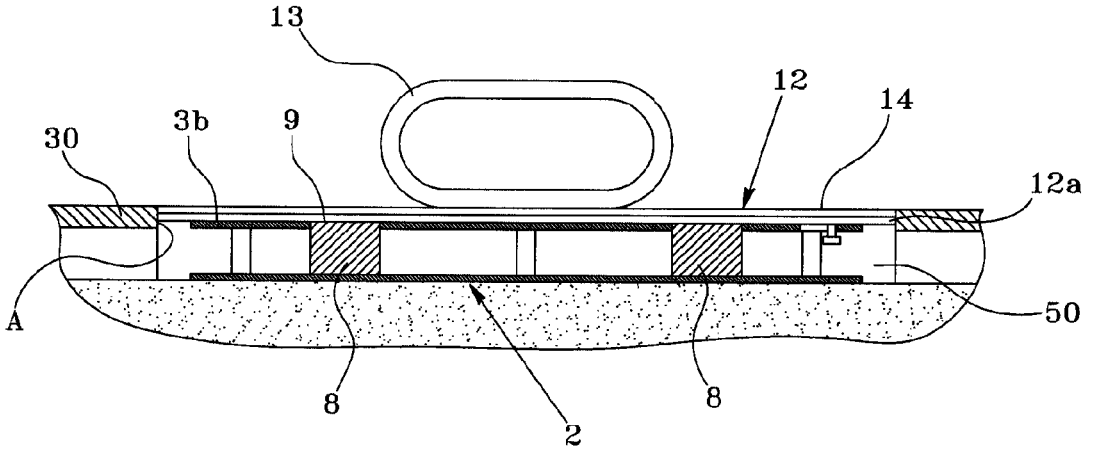

In detail, said housing defines a seat in which the support 2 is completely inserted in such a manner as not to project above the level of the surface of the flooring (FIGS. 3*a* and 3*b*).

In more detail, said support 2 is placed in the housing 50 in such a manner that the upper surface thereof is positioned at a height of less than a few centimeters (1-2 cm) with respect to that of the flooring and at said opening A.

Preferably, in the lower part thereof said support is constrained to the ground with fastening means of known type.

In the embodiment illustrated, said support 2 comprises a body 3, substantially box-shaped, with an upper bearing surface 3*a*.

Figure 1:
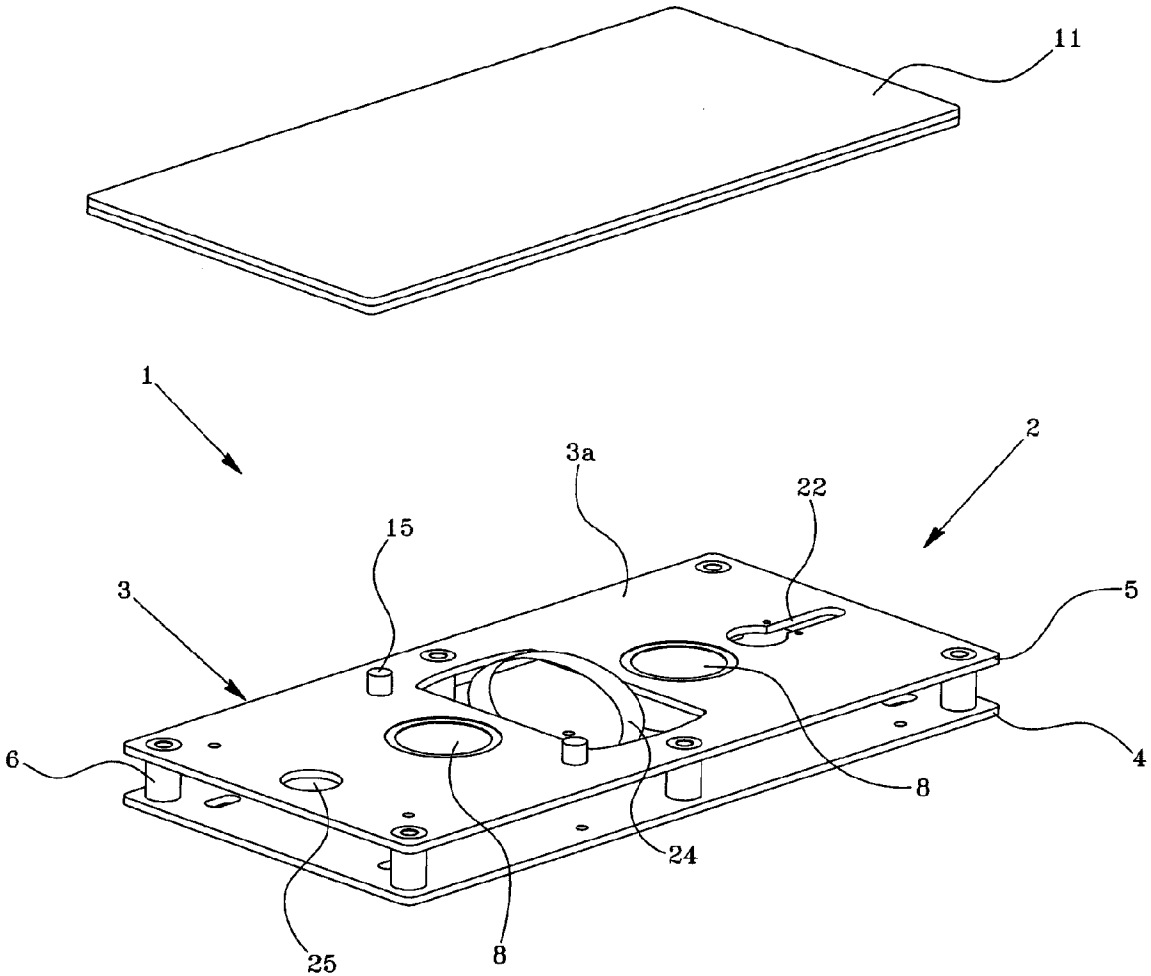
FIG. 1 is a perspective view of the device for the connection of gymnastic equipment to the flooring of a gymnasium or the like, according to a first embodiment of the invention.
Figure 2:
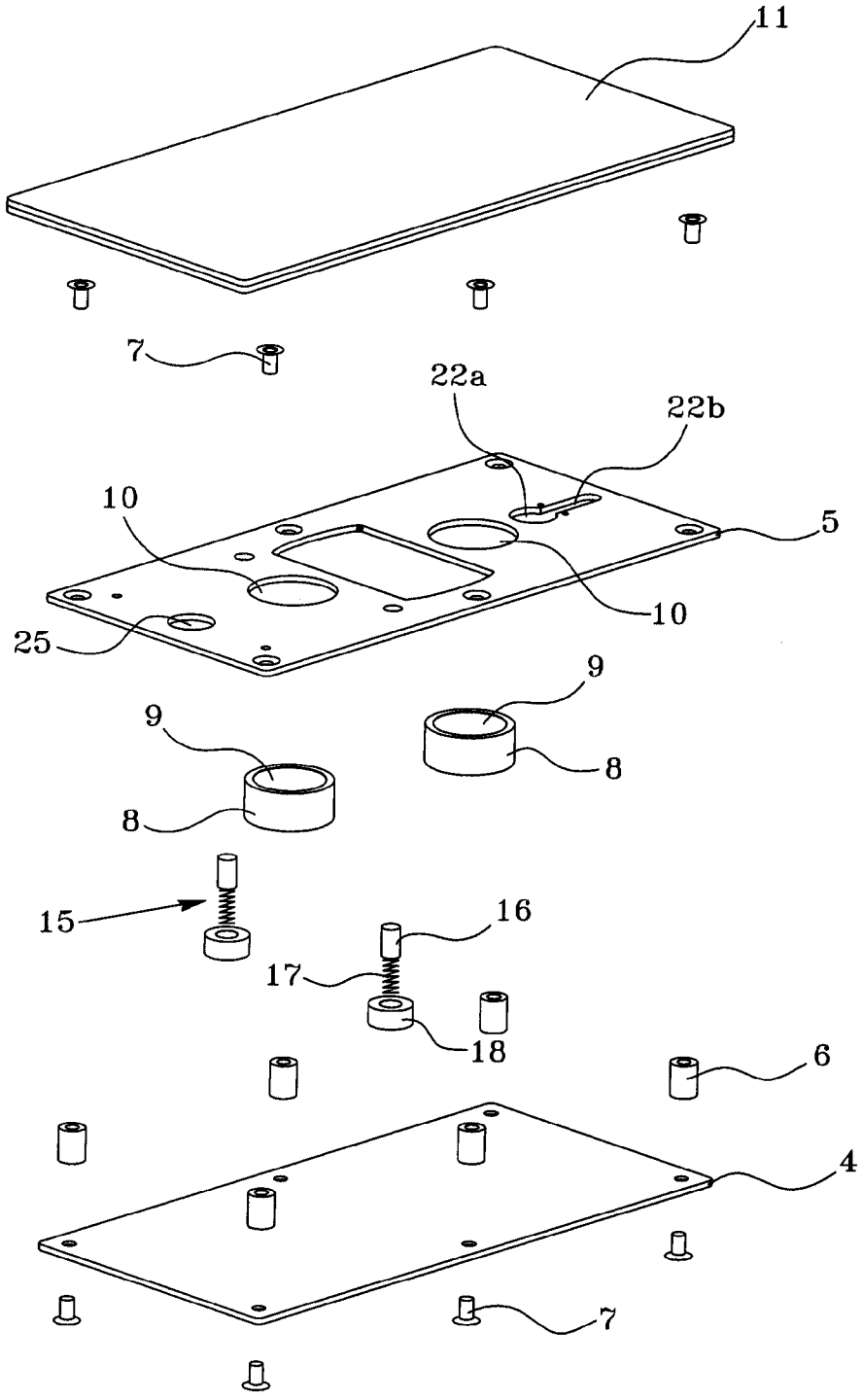
FIG. 2 is an exploded perspective view of the device of FIG. 1.

More in detail, said body 3 comprises a lower plate 4 and an upper plate 5 mutually superimposed and maintained at a distance by a plurality of mutually interposed pins 6. (FIGS. 1-2).

In detail, said pins 6 are threaded at the ends to receive screws 7 which block the two plates 4 and 5 in an integral manner.

Preferably, the support 2, and more precisely the body 3, has a shape substantially complementary to that of the opening A produced in the flooring.

In particular, the support 2 has a shape of dimensions equal to or less than those of the opening A to facilitate insertion and removal of the device 1 in/from the housing 50 for any maintenance operations or for replacement.

In conformity with the invention, the device 1 comprises at least one electromagnet 8 mounted on said support 2.

Said electromagnet is preferably housed between the lower plate 4 and the upper plate 5 and is arranged in such a manner that at least one magnetisable surface 9 is facing upward.

Preferably, the upper plate 5 has an opening 10 having a shape complementary to that of the upper end of the electromagnet 8 in such a manner that the magnetisable surface 9 remains substantially at the same level of the bearing surface 3*a* as the upper plate 5 of the body 3.

The number of electromagnets 8 present on the support 2, and their dimension, can vary according to the dimensions of the support and of the opening A in the flooring.

In the embodiment illustrated, two electromagnets 8 are provided, arranged side by side.

In detail, said electromagnets 8 comprise a permanent magnet surrounded by a coil or winding, supplied with a direct current by a control device 100, adapted to generate a magnetic field approximately of the same intensity but in the opposite direction to that of the permanent magnet.

Said control device is provided with an interface 101 through which it is possible to control the supply or interruption of the current to said coil. (FIG. 8).

In this way, when the coil is not supplied with power the permanent magnet exerts a magnetic force of attraction; instead, when the coil is supplied with power, the two magnetic fields cancel each other out without generating forces of attraction or repulsion.

The device 1 also comprises a slab, indicated as a whole with 11 or 12, preferably having a shape complementary to that of the opening A, adapted to be housed in the aforesaid opening on the bearing surface 3*a* of the support 2.

According to the invention, said slab 11 or 12 comprises at least one portion 11*a* or 12*a* made of ferromagnetic material susceptible to the electromagnetic field generated by the electromagnets 8.

Preferably, said portion 11*a* or 12*a* is placed in the lower layer of the slab in such a manner as to be able to contact the magnetisable surface 9 of the electromagnet 8 when said slab 11 or 12 is positioned in the opening A resting on the support 2.

In the embodiment illustrated, said slab 11 comprises at least a lower layer 11*a* made entirely of a ferromagnetic material, such as steel or other iron alloys (FIG. 3*a*).

According to the invention, said slab 11 or 12 can be used to complete the surface of the flooring, to obtain a totally usable floor surface, or for the connection of gymnastic equipment.

For this first purpose, the slab 11 has a substantially flat upper surface 14, i.e. without raised or projecting parts.

In particular, the slab 11 has a thickness such that, when it is housed in the opening A resting on the support 2, the upper surface thereof 14 is located at the same level as the surface of the flooring.

According to the embodiment illustrated (FIG. 3*a*), the slab comprises an upper layer 11*b*, overlapped on the lower layer 11*a*, preferably made of the same materials as the coating material of the flooring (e.g. wood, PVC, linoleum, etc.).

Alternatively, the slab 12, on the upper surface 14, is provided with means 13 for the connection of gymnastic equipment, such as elastic bands, ropes, poles, punch bags for fitness boxing, platforms and the like, schematized in FIG. 3*b*.

Figure 4A:
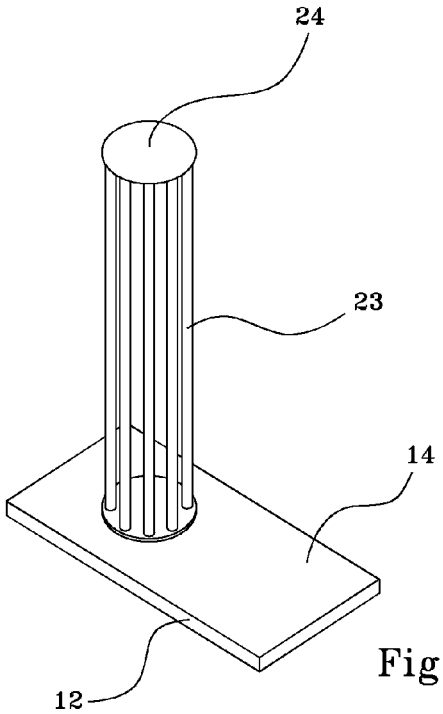
FIGS. 4*a* to 4*c* are perspective views of examples of means for the connection of gymnastic equipment of the device of FIG. 1.
Figure 4B:
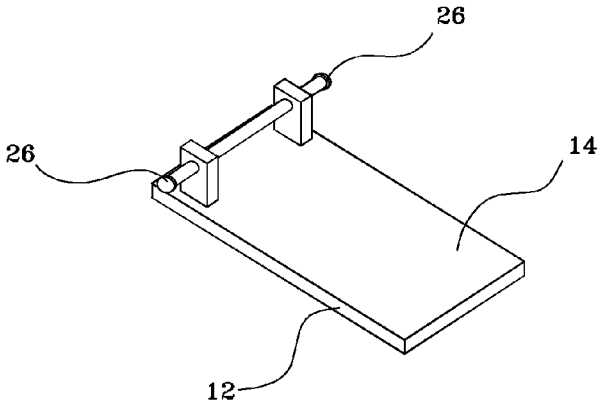
Figure 4C:
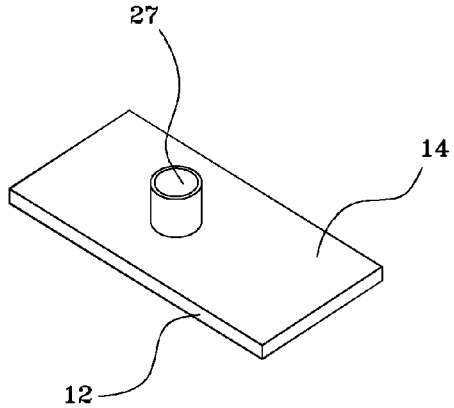

FIGS. 4*a* to 4*c* schematically represent some examples of said connection means 13.

With reference to FIG. 4*a*, there is illustrated a slab 12 in which said means 13 comprise a plurality of vertical rods 23, constrained at the lower end to the surface 14 of the slab 12, and at the upper end to a plate 24.

Said rods 23 can be used by several people simultaneously for the connection of elastic bands, ropes and the like.

With reference to FIG. 4*b*, there is illustrated a slab 12 in which said means 13 comprise an annular element with two projecting extensions 26.

Also said annular element can be used for connection, also through snap hooks or the like, of elastic bands, ropes, cables and the like.

With reference to FIG. 4*c* there is illustrated a slab 12 in which said means 13 comprise one or more sleeves 27 secured in a manner integral with the surface 14 thereof.

Inside said sleeve there can be inserted rods, poles, rods to support punch bags for fitness boxing or the like.

Said sleeve can be provided with a thread on the inner part thereof or with quick release devices to block the elements inserted therein.

The slab 11 or 12 can be made integral with the support 2 or released, acting on the interface 101 of the control device 100 which activates or deactivates the electromagnets 8.

In this way, the slab 11, provided with a flat upper surface 14, can be rapidly and simply replaced with a slab 12 provided with means 13 for the connection of gymnastic equipment.

Thanks to the device of the invention, it is thus possible to produce a flooring that enables the use of its surface both as a usable floor surface (for example for activities such as aerobics or the like), or as a surface equipped for the connection gymnastic equipment such as those mentioned above or others of known type commonly used in sports.

Figure 5A:
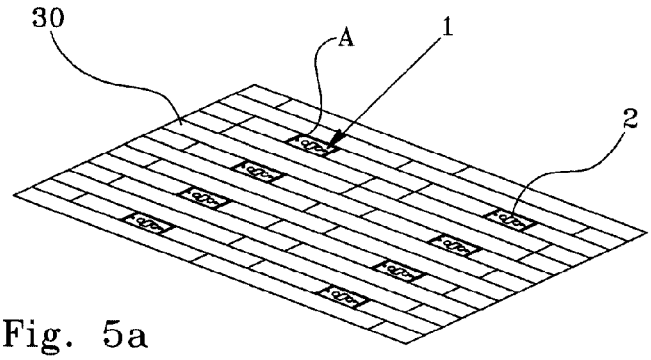
FIGS. 5*a* to 5*c* are perspective views of a flooring provided with a plurality of devices of FIG. 1, respectively provided with the slabs with the flat upper surface, and provided with the slabs with means for the connection of gymnastic equipment.

With reference to FIG. 5*a* there is illustrated a flooring 30 with a plurality of housings 50 in which there are inserted the same number of supports 2 of the device 1.

Figure 5B:
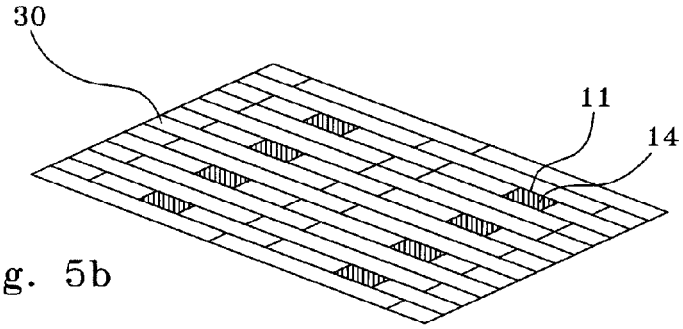

FIG. 5*b* instead illustrates the same flooring 30 in the configuration for use of the surface as a completely usable floor surface.

In detail, the slabs 11 provided with the flat upper surface 14, are placed in the openings A resting on the surfaces 3*a* of the various supports 2.

To reach this configuration, it is sufficient to position said slabs 11 in the openings A so that the upper surface 14 is at the same level as the surface of the flooring.

Then, by acting on the interface 101 of the control device 100, the power supply to the coil is interrupted and the electromagnets 8 are activated to attract said slabs 11 and make them integral with the supports 2.

The slabs 11 are thus firmly constrained and the flooring can be used to perform free body exercises without the risk of said slabs lifting due to pressure exerted by the feet of the users.

Thanks to perfect levelling between the slabs 11 and the rest of the flooring, this has no raised parts or projecting edges which could cause falls or injuries for the users.

Figure 5C:
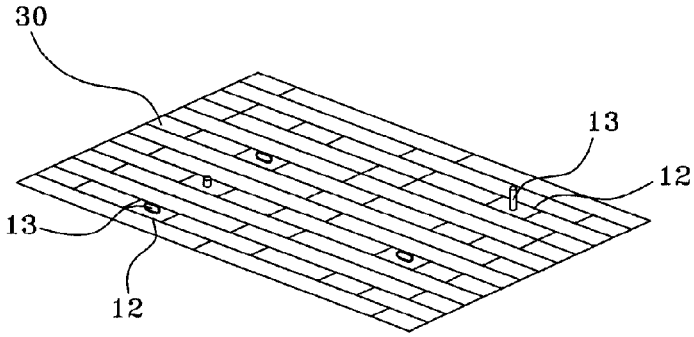

FIG. 5*c* instead illustrates a flooring in the configuration for the connection of gymnastic equipment thereto.

In this configuration, the slabs 12 provided with means 13 for the connection of gymnastic equipment are placed in the openings A.

To change the flooring to this configuration, it is sufficient to deactivate the electromagnets 8, acting on the interface 101, so as to be able to remove the slabs 11 provided with the flat upper surface 14 and replace them with slabs 12 provided with means 13 for the connection of gymnastic equipment.

Replacement of the slabs 11 and 12 can then take place rapidly (even in a few seconds) and without requiring any specific tools.

Figure 6:
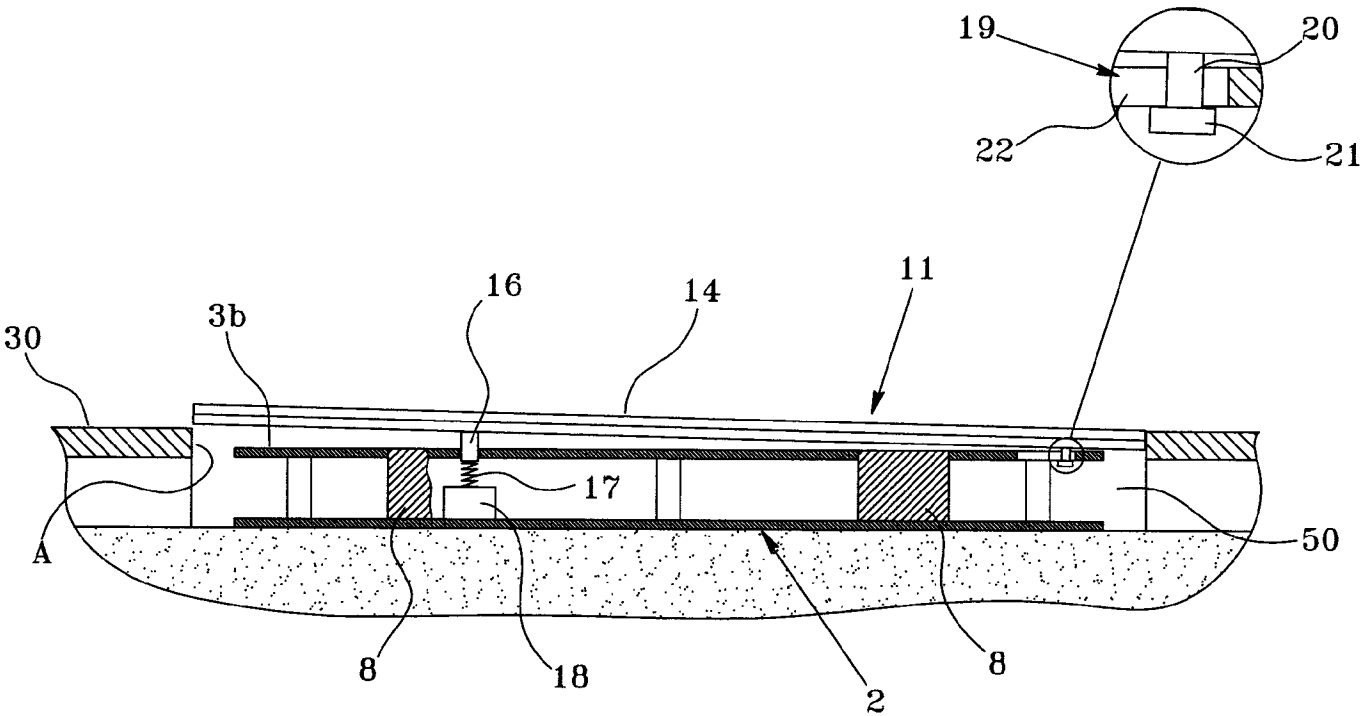
FIG. 6 is a sectional view of the device of FIG. 1 during removal of the slab.

To facilitate removal of the slabs 11 and 12 from the opening A, the device 1 preferably comprises pusher means, indicated as a whole with 15, adapted to push said slabs upward to detach them from the support 2 and make them project partially from said opening A (FIG. 6).

In this way, at least a portion of the slab projects from the surface of the flooring and can be easily grasped by the operator.

In detail, said pusher means comprise at least one pin 16 housed in the support 2 subject to the action of elastic means 17, such as a spring or the like (not visible in the figure), adapted to push the pin upward, making it project from the surface of the upper plate 5.

Said pusher means also comprise an electromagnet 18 which, when active, holds the pin in a withdrawn position in which it does not project from the surface of the upper plate 5 of the support 2, in opposition to the elastic means 17.

Said electromagnet 18 is also supplied with power by the control device 100 and controlled by means of the interface 101.

In detail, when the operator acts on the interface 101 to deactivate the electromagnet 8 that holds the slabs 11 or 12, the control device 100 interrupts the power supply to said electromagnet 18 which is deactivated, releasing the pin 16.

In this way, the elastic means 17 thrust the pin 16 upward, which projecting from the upper plate 5 in turn contacts the lower surface of the slab 11, thrusting it upward and releasing it from the opening A.

Preferably, the device 1 is also provided with mechanical safety locking means 19 to constrain the slab 11 or 12 to the support 2 and more precisely to the upper plate 5, in the event of malfunction of the electromagnets 8.

In detail, said mechanical locking means comprise a pin 20, projecting from the lower surface of the slab 11 or 12, provided with a locking head 21 (FIG. 3).

On the upper plate 5 of the support 2 a slot (22) is produced, configured to house and engage said pin, preventing release thereof when the slab is positioned in the opening A (FIG. 1).

In detail, said slot 22 comprises a first portion 22*a* having a width substantially equal to the dimension of the head 21 of the pin, and a second portion 22*b* having a width substantially equal to that of the pin or in any case smaller with respect to that of the head 21.

To house the slab 11 or 12 in the opening A it is sufficient to insert the head 21 of the pin in the first portion 22*a* of the slot 22 and slide the slab until the head 21 corresponds with the second portion 22*b* of the slot 22.

In this position, the slab is constrained to the support thanks to the head 21 of the pin which, engaged with the portion 22*b* of the slot 22, prevents lifting thereof.

In the event of malfunction of the electromagnets 8 (for example due to a sudden electrical outage) the slab will in any case remain secured to the support also in the presence of a tensile force applied by the user.

Preferably, the support 2 is provided with further means for the connection of gymnastic equipment.

In detail, said connection means are produced on the upper plate 5 of the support 2.

In the embodiment illustrated, said further connection means comprise an annular element 24, preferably made of flexible material, suitable for the connection of elastic bands, ropes or the like.

Preferably, said connection means also comprise a threaded hole 25 produced in the upper plate 5 for the connection of rods, poles or other equipment of known type which require to be blocked on the ground.

Figure 7:
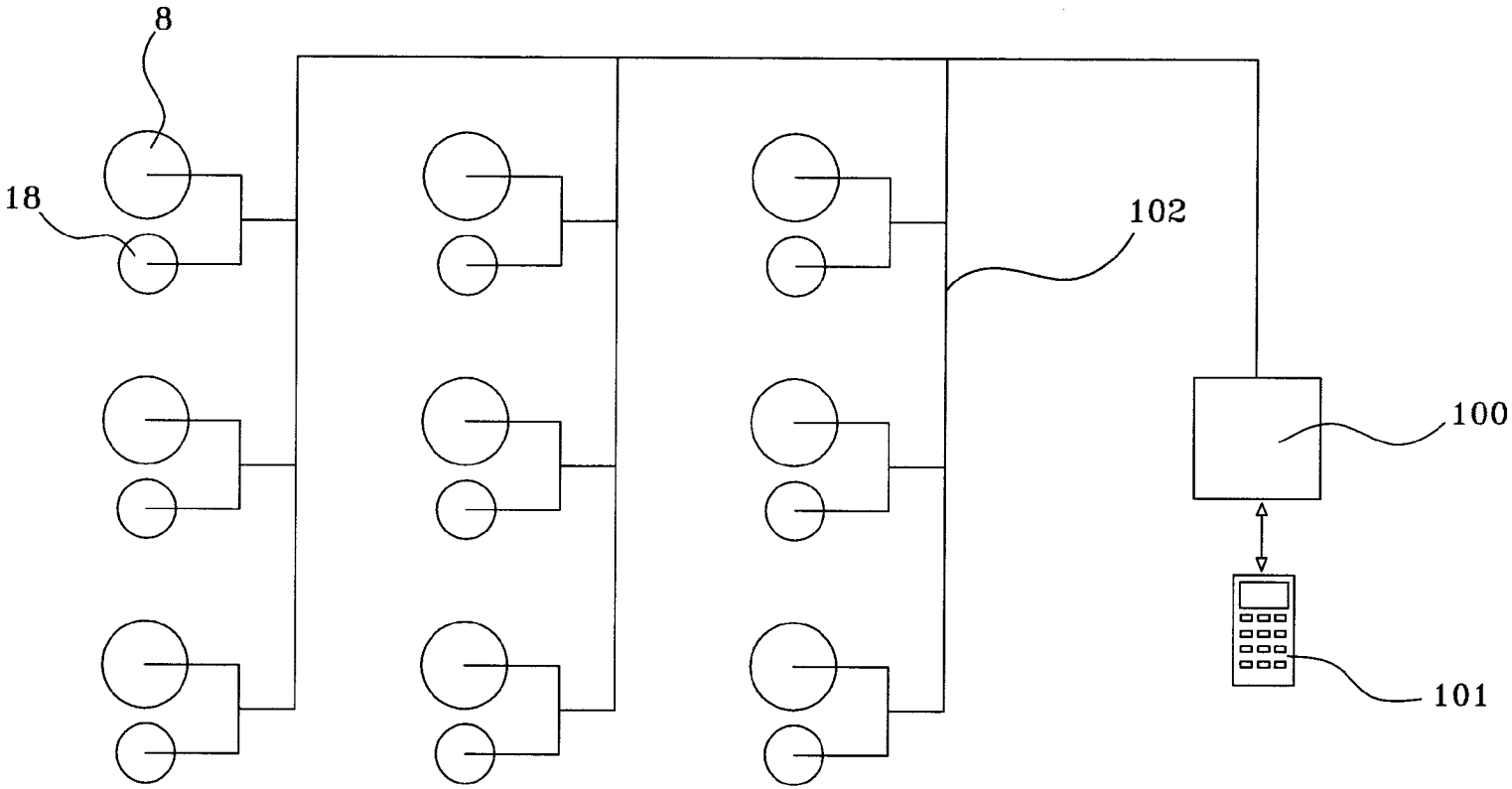
FIG. 7 is a schematic view of the power supply circuit of the devices of FIG. 1.

With reference to FIG. 7, there is schematically illustrated the power supply circuit of the devices for the connection of gymnastic equipment 1 in a flooring of a gymnasium or the like.

Said circuit comprises a control device 100, connected to the electricity network, adapted to supply power through cables 102 to the electromagnets 8 and 18 of the device 1.

Said control device 100 is provided with a transformer unit adapted to receive the input current from the mains and to supply an output current suitable for the type of electromagnets used (current type (direct or alternating), voltage, intensity).

The control device is connected to an interface 101 that can be used by the user to individually control the various devices 1 with which the flooring is provided.

For example, said interface can comprise a numeric keypad in which each key controls activation or deactivation of a given device 1 of the flooring.

Advantageously, said interface can be connected to the control device via wireless connection means so that it can be used by the operator directly in the place in which the device 1 is placed.

Through said interface 101 it is therefore possible to control the power supply to the coil of the electromagnet 8 to cancel the magnetic field of the permanent magnet, deactivating it, and vice versa to interrupt said power supply to reactivate the magnetic field of the permanent magnet.

According to another embodiment, the device 1 comprises a microswitch to interrupt the power supply to the coil of the electromagnet 8.

In detail, said microswitch is operated by a slider placed at the bearing surface 3*a*, which is pressed when the slab 11 or 12 is placed in the opening A.

In this way, reactivation of the electromagnet 8 can take place simply by resting said slab on the surface 3*a* of the support 2 which, pressing the slider, opens the switch interrupting the power supply to the coil.

The present innovation, as described and illustrated, is susceptible to numerous modifications and variants all included in the scope of the inventive concept; moreover, all details can be substituted by other technically equivalent elements.

The invention claimed is:

1. A device (1) for the connection of gymnastic equipment to a flooring (30) of a gymnasium, comprising:

a support (2) for placement in a housing (50) produced in the flooring (30) and accessible from an opening in the flooring (A), at least one electromagnet (8) mounted on said support (2), said electromagnet (8) being connected to a control device (100), and at least one slab (11, 12) adapted to be placed in the opening (A) resting on said support (2), said slab (11, 12) comprising at least one portion (11*a*, 12*a*) made of ferromagnetic material, an upper surface (14) of said slab being at least one of i) substantially flat and ii) provided with means (13) for the connection of gymnastic equipment, said slab being releasable therefrom by acting on the control device (100) that activates or deactivates the electromagnet (8).

2. The device according to claim 1, wherein said support (2) comprises a body (3) with a bearing surface (3*a*), said electromagnet (8) having a magnetizable surface (9) placed substantially at a same level as the bearing surface (3*a*) of the support (2).

3. The device according to claim 2, wherein said slab (11, 12) comprises at least one portion being a lower layer (11*a*, 12*a*) made of ferromagnetic material adapted to contact said magnetizable surface (9) of the electromagnet (8) when the slab (11, 12) is placed in the opening (A).

4. The device according to claim 1, wherein said support (2) is placed in the housing (50) in such a manner that a bearing surface (3*a*) remains at a lower height with respect to a surface of the flooring (30), said slab (11) having a thickness equal to the difference in height between said bearing surface (3*a*) of the support (2) and said surface of the flooring.

5. The device according to claim 1, wherein said upper surface of said slab comprises the connection means, said connection means (13) comprise a plurality of vertical rods 23, constrained at an end to the upper surface (14) of the slab (12), and at an opposite end to a plate (24).

6. The device according to claim 1, wherein said upper surface of said slab comprises the connection means, said connection means (13) comprise an element provided with two projecting extensions (26).

7. The device according to claim 1, wherein said upper surface of said slab comprises the connection means, said connection means (13) comprise a sleeve (27).

8. The device according to claim 1, wherein said support is provided with pusher means (15) adapted to push said slab (11, 12) upward in such a manner as to make said slab project partially from said opening (A).

9. The device according to claim 8, wherein said pusher means comprise at least one pin (16) movable from a withdrawn position in which a at least one pin (16) does not project from the bearing surface (3*a*) to a projecting position in which the at least one pin (16) contacts a lower surface of the slab (11, 12), the pusher means are provided with elastic means (17) adapted to exert a thrust on said at least one pin (16) toward said slab.

10. The device according to claim 9, wherein the device (1) is provided with at least one pusher electromagnet (18) adapted to hold said at least one pin (16) in the withdrawn position in which the at least one pin (16) does not project from said bearing surface (3*a*), in opposition to said elastic means (17).

11. The device according to claim 1, wherein the electromagnet (8) is supplied with power by the control device (100) and controlled by means of an interface (101).

12. The device according to claim 11, wherein said interface comprises a numeric keypad having keys in which each key controls activation or deactivation.

13. The device according to claim 1, wherein the device (1) is provided with mechanical locking means (19) to constrain the slab (11, 12) to the support (2) in the event of malfunction of the electromagnet (8).

14. The device according to claim 13, wherein said mechanical locking means (19) comprise a pin (20) projecting from a lower surface of the slab (11, 12) provided with a locking head (21) and a slot (22) produced on a bearing surface (3*a*), said slot is configured to house and engage at least one pin (16), preventing release thereof when the slab (11, 12) is positioned in the opening (A).

15. The device according to claim 1, wherein said support comprises at least one flexible annular element (24) for the connection of gymnastic equipment.

16. The device according to claim 1, wherein said support comprises at least one threaded hole for the connection of gymnastic equipment, said hole being produced in the bearing surface (3*a*).

17. The device according to claim 1, wherein the device (1) is provided with a microswitch interposed between the control device (100) and the electromagnet (8), said microswitch being operated by a slider placed on a bearing surface (3*a*) of the support (2) in such a manner as to be pressed when the slab (11, 12) is placed in the opening (A).

18. The device according to claim 1, wherein said electromagnet (8) comprise a permanent magnet surrounded by a coil or winding, the coil being supplied with a direct current by the control device (100), so that there is generated a magnetic field approximately of a same intensity but in the opposite direction to that of the permanent magnet.

19. A flooring for gymnasiums comprising one or more devices for the connection of gymnastic equipment according to claim 1.

20. The flooring for gymnasiums according to claim 19, wherein the flooring is provided with the control device (100) adapted to supply the electromagnet (8), and an interface (101) being connected to said control device to activate or disactivate said electromagnet (8).

21. The flooring for gymnasiums according to claim 20, wherein said interface comprises a numeric keypad having keys in which each key controls activation or deactivation.

22. A device (1) for the connection of gymnastic equipment to a flooring (30) of a gymnasium, comprising:

a support (2) for placement in a housing (50) produced in the flooring (30) and accessible from an opening in the flooring (A), at least one electromagnet (8) mounted on said support (2), said electromagnet (8) being connected to a control device (100), and at least one slab (11, 12) adapted to be placed in the opening (A) resting on said support (2), said slab (11, 12) comprising at least one portion (11*a*, 12*a*) made of ferromagnetic material, an upper surface (14) of said slab being at least one of i) substantially flat and ii) provided with means (13) for the connection of gymnastic equipment, said support being provided with pusher means (15) adapted to push said slab (11, 12) upward in such a manner as to make said slab project partially from said opening (A).

23. The device according to claim 22 wherein said pusher means comprise at least one pin (16) movable from a withdrawn position in which the at least one pin (16) does not project from a bearing surface (3*a*) to a projecting position in which the at least one pin (16) contacts a lower surface of the slab (11, 12), the pusher means are provided with elastic means (17) adapted to exert a thrust on said at least one pin (16) toward said slab.

24. The device according to claim 23 wherein said at least one pin (16) is provided with at least one pusher electromagnet (18) adapted to hold said at least one pin (16) in the withdrawn position in which the at least one pin (16) does not project from said bearing surface (3*a*), in opposition to said elastic means (17).

25. The device according to claim 22, wherein the electromagnet (8) is supplied with power by the control device (100) and controlled by means of an interface (101).

26. The device according to claim 25, wherein said interface comprises a numeric keypad having keys in which each key controls activation or disactivation.

27. The device according to claim 22 wherein said pusher means comprise at least one pin (16) housed in the support (2) subject to the action of elastic means (17) adapted to push the pin upward, making the at least one pin (16) project from the upper surface of the support (2).

28. The device according to claim 22, wherein said support (2) comprises a body (3) with a bearing surface (3*a*), said electromagnet (8) having a magnetizable surface (9) placed substantially at a same level as the bearing surface (3*a*) of the support (2).

29. The device according to claim 25, wherein said slab (11, 12) comprises at least one portion being a lower layer (11*a*, 12*a*) made of ferromagnetic material adapted to contact said magnetizable surface (9) of the electromagnet (8) when the slab (11, 12) is placed in the opening (A).

30. The device according to claim 22, wherein said support (2) is placed in the housing (50) in such a manner that a bearing surface (3*a*) remains at a lower height with respect to the surface of the flooring (30), said slab (11) having a thickness equal to the difference in height between said bearing surface (3*a*) of the support (2) and said surface of the flooring.

31. The device according to claim 22, wherein said upper surface of said slab comprises the connection means, said connection means (13) comprise a plurality of vertical rods 23, constrained at an end to the upper surface (14) of the slab (12), and at an opposite end to a plate (24).

32. The device according to claim 22, wherein said upper surface of said slab comprises the connection means, said connection means (13) comprise an element provided with two projecting extensions (26).

33. The device according to claim 22, wherein said upper surface of said slab comprises the connection means, said connection means (13) comprise a sleeve (27).

34. The device according to claim 22, wherein the device (1) is provided with mechanical locking means (19) to constrain the slab (11, 12) to the support (2) in the event of malfunction of the electromagnet (8).

35. The device according to claim 34, wherein said mechanical locking means (19) comprise a pin (20) projecting from a lower surface of a slab (11, 12) provided with a locking head (21) and a slot (22) produced on the bearing surface (2*a*), said slot (22) is configured to house and engage said at least one pin (16), preventing release thereof when the slab (11, 12) is positioned in the opening A.

36. The device according to claim 22, wherein said support comprises at least one flexible annular element (24) for the connection of gymnastic equipment.

37. The device according to claim 22, wherein said support comprises at least one threaded hole for the connection of gymnastic equipment, said hole being produced in a bearing surface (3*a*).

38. The device according to claim 22, wherein the device (1) is provided with a microswitch interposed between the control device (100) and the electromagnet (8), said microswitch being operated by a slider placed on a bearing surface (3*a*) of the support (2) in such a manner as to be pressed when the slab (11, 12) is placed in the opening (A).

39. The device according to claim 22, wherein said electromagnet (8) comprises a permanent magnet surrounded by a coil or winding, the coil being supplied with a direct current by the control device (100), so that there is generated a magnetic field approximately of a same intensity but in the opposite direction to that of the permanent magnet.

40. A flooring for gymnasiums comprising one or more devices for the connection of gymnastic equipment according to claim 22.

41. The flooring for gymnasiums according to claim 40, wherein the flooring is provided with the control device (100) adapted to supply the electromagnet (8), and an interface (101) being connected to said control device to activate or disactivate said electromagnet (8).

42. The flooring for gymnasiums according to claim 41, wherein said interface comprises a numeric keypad having keys in which each key controls activation or deactivation.

* * * * *